US006600273B2

(12) United States Patent
Kim et al.

(10) Patent No.: US 6,600,273 B2
(45) Date of Patent: Jul. 29, 2003

(54) HIGH-POWER ELECTRONIC BALLAST FOR FLUORESCENT LAMP

(75) Inventors: Jong-Sun Kim, Kyungki-do (KR); Choong-Sik Yoo, Kyungki-do (KR); Jong-Man Jung, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/921,600

(22) Filed: Aug. 6, 2001

(65) Prior Publication Data

US 2002/0140375 A1 Oct. 3, 2002

(30) Foreign Application Priority Data

Dec. 23, 2000 (KR) ..... 2000-81006

(51) Int. Cl.[7] ..... H05B 37/00

(52) U.S. Cl. ..... 315/247; 315/209 PZ; 310/316.01

(58) Field of Search ..... 315/224, 209 PZ, 315/247; 310/316.01

(56) References Cited

U.S. PATENT DOCUMENTS 5,834,906 A * 11/1998 Chou et al. ..... 315/247
5,907,223 A * 5/1999 Gu et al. ..... 315/247
6,153,962 A * 11/2000 Noma et al. ..... 310/316.01
6,259,215 B1 * 7/2001 Roman ..... 315/224

* cited by examiner

*Primary Examiner*—David Vu
(74) *Attorney, Agent, or Firm*—Lowe Hauptman Gilman & Berner, LLP

(57) ABSTRACT

Disclosed is a high-power ballast inexpensively applicable to a fluorescent lamp of the 28-Watt class without any increase in the number of constituent elements used or any complexity in the manufacturing process. The high-power ballast includes a rectifier circuit for rectifying a low-frequency AC voltage to convert it into a direct current DC voltage, a power factor compensation circuit for compensating a power factor for the voltage outputted from the rectifier circuit, thereby boosting the level of the output voltage, the power factor compensation circuit including an active type power factor driver, and an inverter circuit for converting the DC voltage, outputted from the power factor compensation circuit, into a desired high-frequency AC voltage. The inverter circuit includes an inverter, a resonator circuit connected to the inverter, and a high-power piezoelectric transformer having an input terminal connected to the resonator circuit and an output terminal connected to the fluorescent lamp. The high-power piezoelectric transformer is made of a composition expressed by the following chemical formula:

$$Pb_{1-a}Sr_a\left[\left(Ni_{\frac{1}{2}}W_{\frac{1}{2}}\right)_b\left(Mn_{\frac{1}{3}}Nb_{\frac{2}{3}}\right)_c(Zr_{1-x}Ti_x)_{1-b-c}\right]O_3 + kPbO.$$

The high-power piezoelectric transformer serves to apply, as a drive voltage, the high-frequency AC voltage to the fluorescent lamp and includes a substantially rhombic input electrode centrally formed on each of upper and lower surfaces of a piezoelectric body block and adapted as the input terminal.

13 Claims, 4 Drawing Sheets

HIGH-POWER ELECTRONIC BALLAST FOR FLUORESCENT LAMP

BACKGROUND OF THE INVENTION

1. Field of the Invention

The present invention relates in general to a ballasting and power factor compensation circuit for a fluorescent lamp using a piezoelectric element, and more particularly to a high-power ballast using a piezoelectric transformer adapted to generate high power of the 28-Watt class, thereby being applicable to general fluorescent lamps of the 28-Watt class.

2. Description of the Prior Art

Piezoelectric transformers, which utilize mechanical vibrations to conduct voltage transforming and power transferring functions, are mainly used in power supply circuits because they have advantages of easy miniaturization and no requirement of any magnetic shield, as compared to known coiled transformers.

Recently, the application of such piezoelectric transformers has been extended to inverters for cold cathode ray tubes and to ballasts for low-power fluorescent lamps.

Fluorescent lamps, which are a kind of discharge tubes, must use high voltage at an initial drive stage so as to emit thermions required for a discharge operation. Such a fluorescent lamp has negative resistance characteristics in that the voltage applied to the fluorescent lamp following the discharge operation is reduced in inverse proportion to an increase in the amount of current flowing through the fluorescent lamp.

Therefore, a ballast used for such a fluorescent lamp must serve to supply high voltage required for a turning on of the fluorescent lamp while controlling the amount of current flowing through the fluorescent lamp, following the turning on, thereby maintaining a desired brightness.

By virtue of such a function, the ballast has a direct influence on the efficiency and life of the fluorescent lamp to which the ballast is applied. For this reason, the ballast should be configured to transform an AC voltage of generally, 50 Hz to 60 Hz into a high frequency of 20 kHz to 100 kHz to be used as a power for the fluorescent lamp, in order to achieve an improvement in the efficiency of the fluorescent lamp.

FIG. 1 is a circuit diagram illustrating a conventional fluorescent lamp ballast using a piezoelectric element. Referring to FIG. 1, a ballast capacitor Cext is connected, in parallel, to a fluorescent lamp 11. A piezoelectric transformer 12 is coupled at its output terminal to the fluorescent lamp 11. The input terminal of the piezoelectric transformer 12 is coupled to a rectifying stage via transistors S1 and S2. For an improvement in power factor, clamping diodes D21 and D22 and a charge pump capacitor Cin are connected to the input terminal of the piezoelectric transformer 12.

The piezoelectric transformer 12 is a $PbTiO_3$ or $Pb(Zr, Ti)O_3$-based piezoelectric element used for low power of the maximum 18-Watt class. In the illustrated case, the charge pump capacitor Cin is provided in the driving circuit of the ballast for a power factor compensation.

The ballast capacitor Cext is adapted to control the voltage applied to the fluorescent lamp in such a fashion that a high voltage is initially applied whereas a low voltage is applied in an ON state of the fluorescent lamp resulting from the high voltage, taking into consideration the load characteristics of the fluorescent lamp exhibiting a high impedance (for example, several mega-ohms) prior to the turning state while exhibiting a relatively low impedance (for example, several kilo-ohms) in the ON state.

In order to obtain a maximum power of 18 Watts or more using the above mentioned configuration, it is necessary to use, for the piezoelectric transformer, piezoelectric elements connected together in parallel or piezoelectric elements having a laminated structure.

For this reason, conventional high-power ballast driving circuits involve an increase in the number of constituting elements used and a complexity in the manufacturing process used. As a result, there is a problem of an increase in manufacturing costs.

Furthermore, the charge pump capacitor Cin adapted for a power factor compensation involves a problem in that it cannot meet a desired standard because it generally provides an insufficient improvement in power factor.

In addition, the ballast capacitor Cext is essentially provided at conventional ballasts. For this reason, in designing a multi-lamp ballast, there may be problems, such as an increase in manufacturing costs and a complicated design, due to an increase in the number of ballast capacitors used.

SUMMARY OF THE INVENTION

Therefore, the present invention has been made in view of the above mentioned problems involved in the prior art, and an object of the invention is to provide a high-power ballast applicable to a fluorescent lamp of the 18-Watt or higher class and the maximum 28-Watt class without any increase in the number of constituting elements used or any complexity in the manufacturing process.

Another object of the invention is to provide a high-power ballast driving circuit capable of achieving turning on and turning off operations without using any ballast capacitor.

In accordance with the present invention, these objects are accomplished by providing a high-power ballast for a high-power fluorescent lamp adapted to supply a drive voltage to the fluorescent lamp, comprising: a rectifier circuit for rectifying a low-frequency AC voltage to convert it into a direct current DC voltage; a power factor compensation circuit for compensating a power factor for the voltage outputted from the rectifier circuit, thereby boosting the level of the output voltage, the power factor compensation circuit including an active type power factor driver; and an inverter circuit for converting the DC voltage, outputted from the power factor compensation circuit, into a desired high-frequency AC voltage, the inverter circuit including an inverter, a resonator circuit connected to the inverter, and a high-power piezoelectric transformer having an input terminal connected to the resonator circuit and an output terminal connected to the fluorescent lamp, the high-power piezoelectric transformer serving to apply, as a drive voltage, the high-frequency AC voltage to the fluorescent lamp.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

The present invention is concerned with Korean Patent Applications No. 2000-23901, 2000-23902 and 2000-23903, previously filed by this applicant on May 4, 2000, which correspond to U.S. application Ser. Nos. 09/723,672, 09/723/670 and 09/846/191, respectively, which U.S. applications are incorporated herein in their entirety by reference.

Now, preferred embodiments of the present invention will be described in detail with reference to the annexed drawings.

Figure 1:
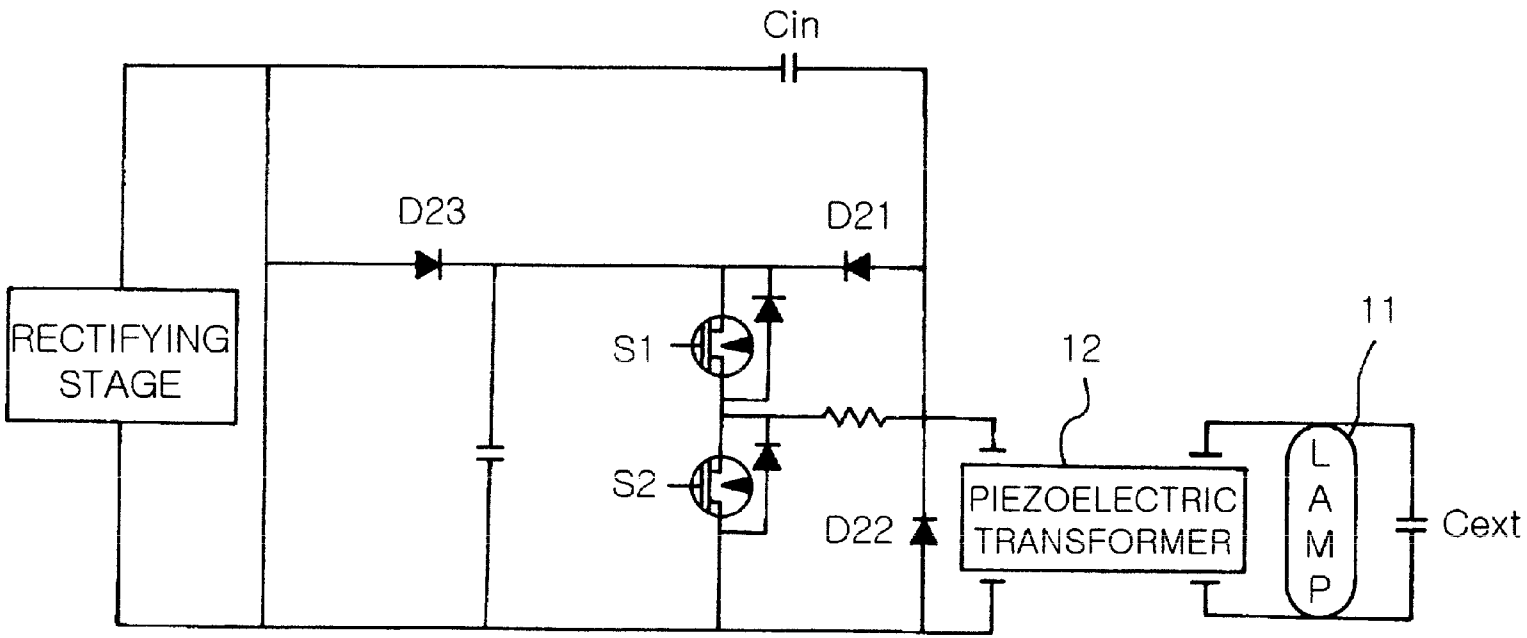
PRIOR ART FIG. 1
FIG. 1 is a circuit diagram illustrating a conventional fluorescent lamp ballast using a piezoelectric element.
Figure 2:
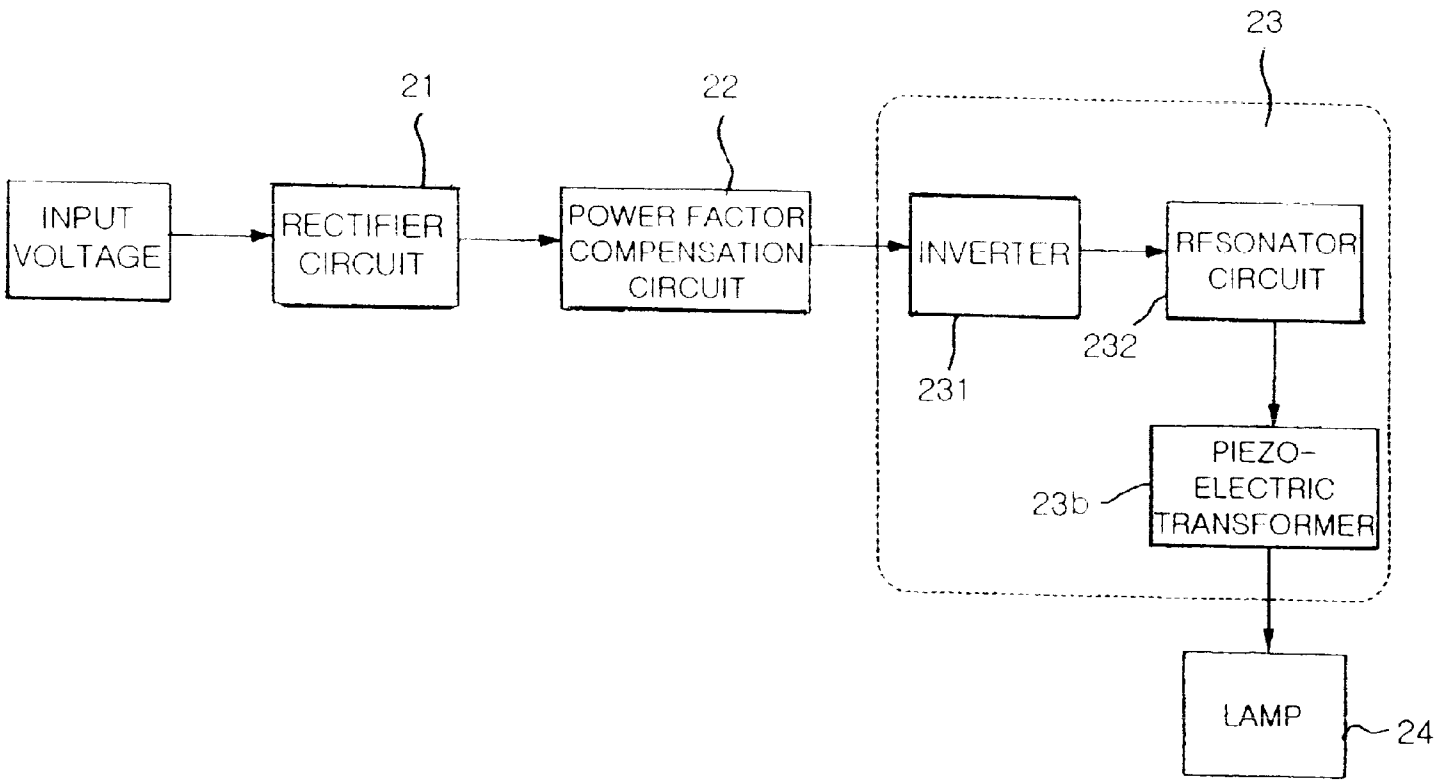
FIG. 2 is a block diagram illustrating a high-power fluorescent lamp ballast according to the present invention.
Figure 3:
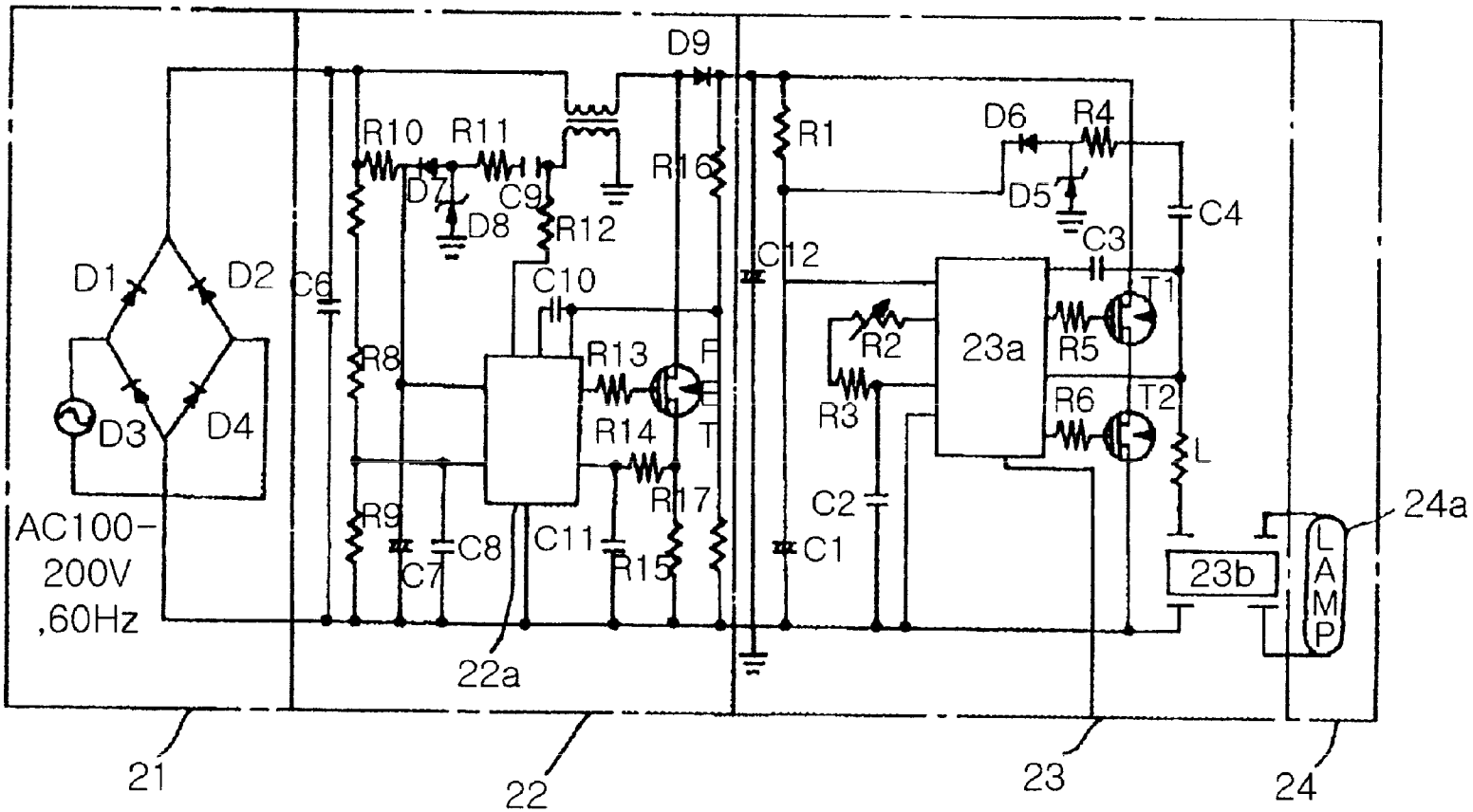
FIG. 3 is a circuit diagram illustrating a circuit configuration of the high-power fluorescent lamp ballast according to an embodiment of the present invention.

With reference to FIG. 2, there is schematically shown in block form the construction of a high-power fluorescent lamp ballast in accordance with the present invention. FIG. 3 is a detailed circuit diagram illustrating an embodiment of the high-power fluorescent lamp ballast. As shown in FIGS. 2 and 3, the high-power fluorescent lamp ballast includes a rectifier circuit 21 for rectifying an input commercial AC voltage to convert it into a direct current DC voltage of a predetermined level, a power factor compensation circuit 22 for compensating a power factor for the input AC voltage, thereby controlling the DC voltage, outputted from the rectifier circuit 21, to be constant irrespective of a variation in the input AC voltage, and an inverter circuit 23 for converting the DC voltage, outputted from the power factor compensation circuit 22, into a desired AC voltage. The inverter circuit 23 includes an inverter 231, a resonator circuit 232, and a high-power piezoelectric transformer 23*b*. A lamp 24 is connected to an output terminal of the high-power piezoelectric transformer 23*b* of the inverter circuit 23 so that it is turned on by the high-frequency AC voltage outputted from the piezoelectric transformer 23*b*. In the illustrated case, the lamp 24 comprises a fluorescent lamp denoted by the reference numeral 24*a* in FIG. 3. The high-power piezoelectric transformer 23*b* may preferably be made of a composition of $Pb_{l-a}Sr_a[(Ni_{1/2}W_{1/2})_b,(Mn_{1/3}Nb_{2/3})_c(Zr_{l-x}Ti_x)_{l-b-c}]O_3+kPbO$, where a is in the range of 0~0.06 mol, b is in the range of 0.01~0.05 mol, c is in the range of 0.01~0.09mol, x is in the range of 0.47~0.53 mol and k is in the range of 0.1~0.7 wt %.

The high-power piezoelectric transformer 23*b* may preferably be made of a composition of $$Pb_{1-a}Sr_a\left[\left(Ni_{\frac{1}{2}}W_{\frac{1}{2}}\right)_b\left(Mn_{\frac{1}{3}}Nb_{\frac{2}{3}}\right)_c(Zr_{1-x}Ti_x)_{1-b-c}\right]O_3+kPbO,$$

where a is 0~0.06 mol %, b is 0.01~0.05 mol %, c is 0.01~0.09 mol %, x is 0.47~0.53 mol % and k is 0.1~0.7 wt %.

Namely, the piezoelectric transformer 23*b* may preferably be made of a four-component system appropriate to a high-power characteristic of the 28-Watt class by adding $$Pb\left(Mn_{\frac{1}{3}}Nb_{\frac{2}{3}}\right)$$

to a two-component system of $Pb(Zr,Ti)O_3$ to increase a mechanical quality coefficient Qm and electromechanical coupling coefficient Kp of the transformer and then adding $$Pb\left(Ni_{\frac{1}{2}}W_{\frac{1}{2}}\right)$$

to the resulting composition to increase a dielectric constant of the transformer while reducing its sintering temperature. As an alternative, Sr may replace a certain amount of Pb to increase the dielectric constant of the transformer while preventing a temperature characteristic of a resonance frequency from being degraded due to $$Pb\left(Mn_{\frac{1}{3}}Nb_{\frac{2}{3}}\right)$$

and to prevent a deterioration in physicochemical properties even when a high voltage is applied to the transformer.

The above composition of the piezoelectric transformer 23*b* is in detail disclosed in Korean Patent Applications No. 2000-23901 and 2000-23902, previously filed by this applicant.

The piezoelectric transformer 23*b* may preferably include a substantially rhombic or cruciform input electrode centrally formed on each surface of a piezoelectric body block, and an output electrode formed on the piezoelectric body block such that it surrounds the input electrode while being spaced apart from the input electrode by a desired distance, as will hereinafter be described in detail with reference to FIG. 4. With this structure, the piezoelectric transformer can minimize the magnitude of stress applied to the piezoelectric body block so as to prevent heat from being generated in the block and in turn the block from being damaged or degraded in its efficiency.

Figure 4A:
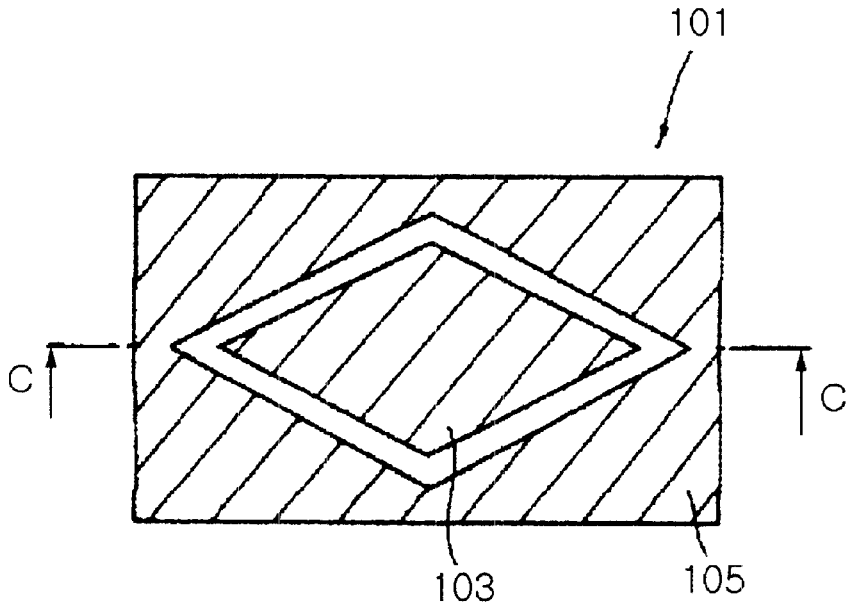
FIGS. 4A and 4B are perspective views illustrating a piezoelectric transformer used in the high-power fluorescent lamp ballast in accordance with the present invention.
Figure 4B:
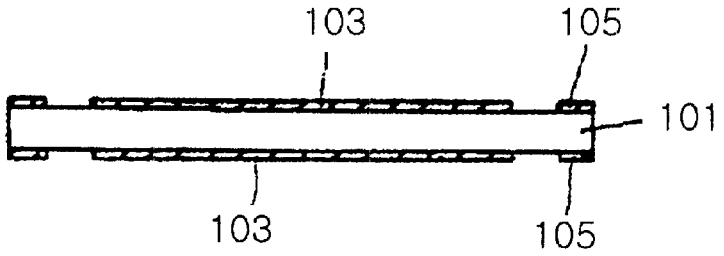

FIG. 4 shows an embodiment of the high-power piezoelectric transformer 23*b* in accordance with the present invention, wherein FIG. 4*a* is a top view of the transformer and FIG. 4*b* is a sectional view of the transformer. As shown in these drawings, the high-power piezoelectric transformer 23*b* includes a substantially hexahedral piezoelectric body block 101, a substantially rhombic input electrode 103 centrally formed on each of the upper and lower surfaces of the piezoelectric body block 101, and an output electrode 105 formed on each of the upper and lower surfaces of the piezoelectric body block 101 such that it surrounds the input electrode 103 while being spaced apart from the electrode 103 by a desired distance.

In the piezoelectric transformer shown in FIG. 4, an increased magnitude of stress is exhibited at the central portion of the piezoelectric body block Meanwhile, in most cases, mechanical vibrations, which are generated owing to an electrical signal input, exist strongly near the input and output electrodes of the piezoelectric transformer. On the basis of these facts, molding the size of the electrodes at the central portion of the transformer smaller can reduce the magnitude of stress, and in turn, the amount of heat being generated.

The above-stated structure and operation of the piezoelectric transformer is in detail disclosed in Korean Patent Application No. 2000-23903, previously filed by this applicant.

The high-power piezoelectric transformer 23*b* in the fluorescent lamp ballast according to the present invention may preferably be operated at 66 KHz.

In the ballast driving circuit having the above described configuration, a low-frequency AC voltage input is converted into a DC voltage of a predetermined level by the rectifier circuit 21. The output from the rectifier circuit 21 is applied to the power factor compensation circuit 22 which, in turn, conducts a power factor compensation for the AC voltage input. The DC voltage from the power factor compensation circuit 22 is applied to the inverter circuit 13, so that it is converted into a desired AC voltage by the inverter 231 of the inverter circuit 13. The AC voltage from the inverter 231 is then sent to the fluorescent lamp 24*a* via the resonator circuit 232 and high-power piezoelectric transformer 23*b*.

The operation of the inverter circuit 23 will be described in more detail, with reference to FIG. 3.

Referring to FIG. 3, an inverter driver 23*a* is shown which serves to conduct a switching operation at a frequency set by switching transistors T1 and T2. In accordance with the switching operation, the inverter driver 23*a* generates an AC voltage of a high frequency predetermined for the DC voltage inputted to the inverter circuit 23. By this high-frequency AC voltage, a DC resonator circuit corresponding to the resonator circuit 232 of FIG. 2 resonates. In FIG. 3, the DC resonator circuit is composed of an inductor L and a capacitance component of the piezoelectric transformer 23*b*. As the DC resonator circuit resonates at the high frequency set by the inverter driver 23*a*, a desired high-frequency AC voltage is applied to the fluorescent lamp 24*a* connected to the output terminal of the high-power piezoelectric transformer 23*b*. Thus, the fluorescent lamp 24*a* is turned on.

The power factor compensation circuit 22 does not have a passive type configuration using a charge pump, but has an active type configuration using a power factor driver IC. This is because there is a severe deviation between the switching transistor and coil in the passive type configuration, so that it is difficult to obtain a desired quality. An increased defective rate is also involved in the passive type configuration. On the other hand, the active type configuration has advantages in that it does not involve any design deviation while having a uniform quality. By virtue of such advantages, the active type configuration is used for the power factor compensation circuit 22 in accordance with the present invention.

The ballast driving circuit having the above described configuration does not require the use of a ballast capacitor adapted for the initial turning on of a lamp because the output characteristics of the high-power piezoelectric transformer 23*b* well matches with the load characteristics of a fluorescent lamp of the 28-Watt class, as compared to conventional ballasts.

Even though a fluorescent lamp exhibits a high impedance of for example, several mega-ohms, it can be turned on because the piezoelectric transformer 23*b* has a sufficient mechanical quality coefficient Qm to generate a voltage with sufficiently high power characteristics. Once the fluorescent lamp turns on, it maintains a stable voltage state, even though it exhibits a relatively low impedance of, for example, 950 Ω (in the case of the 28-Watt class). Accordingly, the ballast of the present invention can operate normally without using any ballast capacitor.

In this regard, the ballast of the present invention is considerably advantageous in terms of the manufacturing costs, as compared to conventional ballasts. In particular, the ballast of the present invention is advantageous where it is designed as a coiled multi-lamp ballast. Coiled multi-amp ballasts designed in conventional cases inevitably involve an increase in the number of ballast capacitors (for example, four ballast capacitors for two lamps and six ballast capacitors for three lamps). In the case of the ballast according to the present invention, however, such a problem involved in conventional cases is avoided because no ballast capacitor is used. Accordingly, it is possible to achieve a reduction in the manufacturing costs while providing a freedom to design a miniature and light weight structure.

Also, even when the input voltage varies between 110 V and 220 V or when the fluorescent lamp is configured to use a voltage of free power of for example, 14 to 28 Watts, the ballast driving circuit according to the present invention can generate stable power for the fluorescent lamp without any considerable circuit modification.

This is because a smooth LC resonance is generated by virtue of maintaining superior matching of the high-power piezoelectric transformer 23*b* with the fluorescent lamp, even when the input voltage or output load varies.

The following Table 1 is a comparison of the ballast driving circuit according to the present invention with conventional products in terms of diverse characteristics.

| Ballast Product | Input Voltage Vi [V] | Input Current Ii [A] | Input Power W | Power Factor PF | Harmonic Wave Content of Current THD [%] | Crest Factor CF | Frequency KHz | Remark |
|---|---|---|---|---|---|---|---|---|
| Present | 120 | 0.287 | 34 | 0.99 | 7 | 1.4 | 66 | |
| Invention | 220 | 0.153 | 34 | 0.98 | 10 | 1.4 | 66 | |
| Magnetek | 120 | 0.29 | 34 | 0.99 | 10 | 1.5 | | Test Lamp: T5 Lamp |
| Motorola | 120 | 0.31 | 34 | 0.99 | 10 | 1.5 | | Osram |
| Sylvania | 120 | 0.26 | 31 | 0.98 | 10 | 1.7 | | FH28W/8 |
| Advance | 120 | 0.29 | 34 | 0.98 | 10 | | | 60 |

Referring to Table 1, it can be seen that the ballast having a ballasting and power factor compensation circuit using a piezoelectric element in accordance with the present invention exhibit a superior power factor and an improved harmonic wave content of current. It can also be seen that the ballast of the present invention exhibits superior characteristics, in terms of the crest factor having a direct influence on the life of the fluorescent lamp, in that it has a crest factor of 1.7 or less As apparent from the above description, the present invention provides a ballasting and power factor compensation circuit for a fluorescent lamp of the 28-Watt class, which uses a high-power piezoelectric transformer; thereby being capable of eliminating the need for any ballast capacitor. Accordingly, it is possible to achieve a reduction in the manufacturing costs in designing a multi-amp ballast while providing a freedom to design a miniature and fight weight structure. Also, the piezoelectric transformer has piezoelectric characteristics compatible with the load characteristics of the 28-Watt class fluorescent lamp. Accordingly, it is possible to use a free voltage of 110 to 220 V or a voltage of free power of 14 to 28 Watts. In addition, an easy installation of the ballast can be achieved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high-power ballast for a high-power fluorescent lamp adapted to supply a drive voltage to the fluorescent lamp said ballast, comprising:

a rectifier circuit for rectifying a low-frequency AC voltage to convert the AC voltage into a direct current (DC) voltage;

a power factor compensation circuit for compensating a power factor for the voltage outputted from the rectifier circuit, thereby boosting the level of the output voltage, the power factor compensation circuit including an active type power factor driver; and an inverter circuit for converting the DC voltage, outputted from the power factor compensation circuit, into a desired high-frequency AC voltage, the inverter circuit including an inverter, a resonator circuit connected to the inverter, and a high-power piezoelectric transformer having an input terminal connected to the resonator circuit and an output terminal connected to the fluorescent lamp, the high-power piezoelectric transformer serving to apply, as the drive voltage, the high-frequency AC voltage to the fluorescent lamp, said piezoelectric transformer including a substantially hexahedral piezoelectric body block, a substantially rhombic input electrode centrally formed on each of upper and lower surfaces of the piezoelectric body block, the input electrode serving as the input terminal, and an output electrode formed on each of the upper and lower surfaces of the piezoelectric body block so as to surround the input electrode while being spaced apart from the input electrode by a desired distance, the output electrode serving as the output terminal.

2. The ballast set forth in claim 1, wherein the high-power piezoelectric transformer is made of a composition expressed by the following chemical formula:

$$Pb_{1-a}Sr_a\left[\left(Ni_{\frac{1}{2}}W_{\frac{1}{2}}\right)_b\left(Mn_{\frac{1}{3}}Nb_{\frac{2}{3}}\right)_c(Zr_{1-x}Ti_x)_{1-b-c}\right]O_3+kPbO.$$

3. The ballast set forth in claim 2, wherein, in the chemical formula, a is in a range of 0~0.06 mol, b is in a range of 0.01~0.05 mol, c is in a range of 0.01~0.09 mol, x is in a range of 0.47~0.53 mol, and k is in a range of 0.1~0.7 wt %.

4. The ballast as set forth in claim 1, wherein the high-power piezoelectric transformer is operated at 66 KHz.

5. A high-power ballast adapted to supply a drive voltage to a high-power fluorescent lamp, said ballast comprising:

a rectifier circuit for rectifying a low-frequency AC voltage to convert the low-frequency AC voltage into a direct current (DC) voltage;

a power factor compensation circuit coupled to said rectifier circuit for maintaining the DC voltage outputted from said rectifier at a constant level, the power factor compensation circuit including an active type power factor driver; and an inverter circuit coupled to said power factor compensation circuit for performing a switching operation to convert a power factor-compensated DC voltage received from said power factor compensation circuit into a high-frequency AC voltage;

wherein the inverter circuit includes an inverter, a resonator circuit connected to the inverter, and a high-power piezoelectric transformer having an input terminal connected to the resonator circuit and an output terminal adapted to be connected to the fluorescent lamp for supplying the fluorescent lamp with the high-frequency AC voltage as the drive voltage; and wherein said high-power piezoelectric transformer is made of a composition expressed by the following chemical formula:

$$Pb_{1-a}Sr_a\left[\left(Ni_{\frac{1}{2}}W_{\frac{1}{2}}\right)_b\left(Mn_{\frac{1}{3}}Nb_{\frac{2}{3}}\right)_c(Zr_{1-x}Ti_x)_{1-b-c}\right]O_3+kPbO.$$

6. The ballast of claim 5, wherein, in the chemical formula, a is in a range of 0~0.06 mol, b is in a range of 0.01~0.05 mol, c is in a range of 0.0~0.09 mol, x is in a range of 0.47~0.53 mol, and k is in a range of 0.1~0.7 wt %.

7. The ballast of claim 5, wherein said piezoelectric transformer includes a substantially hexahedral piezoelectric body block;

a substantially rhombic input electrode centrally formed on each of upper and lower surfaces of the piezoelectric body block, the input electrode serving as the input terminal, and an output electrode formed on each of the upper and lower surfaces of the piezoelectric body block so as to surround the input electrode while being spaced apart from the input electrode by a predetermined distance, the output electrode serving as the output terminal.

8. The ballast of claim 7, wherein each of the output electrodes of said piezoelectric transformer completely encircles the respective input electrode.

9. The ballast of claim 8, wherein the input electrodes of said piezoelectric transformer are coupled to output terminals of said resonance circuit for applying said high-frequency AC voltage to said piezoelectric body, and the output electrodes of said piezoelectric transformer are adapted to be coupled to the lamp.

10. The ballast of claim 5, wherein said piezoelectric transformer includes a piezoelectric body having opposite first and second faces;

at least a first input electrode formed on said first face of said piezoelectric body; and at least a first output electrode formed on said first face of said piezoelectric body, said first output electrode surrounding, while being spaced from, the first input electrode.

11. The ballast of claim 10, wherein said piezoelectric body is a piezoelectric block;

said first input electrode is disposed closer to a central region of each side of said first face than to a corner region on said first face, the input electrode serving as the input terminal; and said first output electrode is separated from the first input electrode by a constant distance at a peripheral region on said first face so that a size of said first output electrode at the central region of each side of said first face is smaller than at the corner region of said first face, the first output electrode serving as the output terminal.

12. The ballast of claim 11, wherein said piezoelectric transformer further includes a second input electrode formed on said second face of said piezoelectric body; and a second output electrode formed on said second face of said piezoelectric body, said second output electrode surrounding, while being spaced from, the second input electrode;

wherein the second input electrode is disposed closer to a central region of each side of said second face than to a corner region on said second face; and the second output electrode is separated from the second input electrode by a constant distance at a peripheral region on said second face so that a size of said second output electrode at the central region of each side of said second face is smaller than at the corner region of said second face.

13. The ballast of claim 5, wherein said high-power piezoelectric transformer operates at 66 KHz.

* * * * *